United States Patent [19]

McQuary

[11] 4,247,116

[45] Jan. 27, 1981

[54] INDICATING TARGET

[76] Inventor: Kenneth L. McQuary, 15414 Condon Ave., Lawndale, Calif. 90260

[21] Appl. No.: 3,886

[22] Filed: Jan. 16, 1979

Related U.S. Application Data

[63] Continuation-in-part of Ser. No. 854,021, Nov. 23, 1977, abandoned.

[51] Int. Cl.[3] ..... F41J 7/00

[52] U.S. Cl. ..... 273/394; 273/408; 273/407; 273/404; 273/DIG. 4

[58] Field of Search ..... 273/102.4, 103, 102.5, 273/102 B, 102.1 C, 102.1 CM, 105.6, DIG. 4, 404, 406, 407, 408, 394, 396, 397; 40/518; 242/96, 129.8, 55.2, 156, 68

[56] References Cited

U.S. PATENT DOCUMENTS

| | | | |
|---|---|---|---|
| 1,395,508 | 11/1921 | Mason et al. | 40/518 |
| 1,523,976 | 1/1925 | Meyer | 40/518 |
| 1,886,562 | 11/1932 | Le Fever | 273/102.4 X |
| 1,935,174 | 11/1933 | Bisaillon et al. | 273/102.4 |
| 2,013,133 | 9/1935 | Caswell | 273/102.4 |
| 2,034,839 | 3/1936 | Sheffield | 273/382 |
| 3,088,738 | 5/1963 | Meyer | 273/DIG. 4 X |
| 3,122,367 | 2/1964 | Dale | 273/102.4 |
| 3,319,960 | 5/1967 | Wilcox | 273/102.1 CM X |
| 3,519,272 | 7/1970 | De Vogelaere | 273/102.4 X |
| 3,682,478 | 8/1972 | Knight | 273/DIG. 4 X |
| 3,720,411 | 3/1973 | De Vogelaere | 273/DIG. 4 X |
| 3,738,589 | 6/1973 | Brayman | 242/96 |
| 3,899,175 | 8/1975 | Loe | 273/102 B X |

FOREIGN PATENT DOCUMENTS

| | | | |
|---|---|---|---|
| 283995 | 11/1952 | Switzerland | 273/105.6 |
| 12539 | of 1905 | United Kingdom | 273/105.6 |

*Primary Examiner*—Paul E. Shapiro

*Attorney, Agent, or Firm*—Christie, Parker & Hale

[57] ABSTRACT

A target system for use with spring, air, and $CO_2$ operated pistols and rifles and with slingshots. The target system prevents ricochets by use of a flexible backstop suspended within a housing while permitting the shooter and spectators to easily discern where the projectiles have penetrated a target which is disposed across the front of this housing. The system utilizes supports incorporated into the housing to receive tubes upon which the target is wound for easy movement and removal of used targets and installation of a new roll of targets to replace a used roll. Each individual target on the roll is indexed to a display position by hand winding of the tubes. A locking mechanism incorporated into the supports cooperates with the tubes and wound target material to tautly position each target in the target opening. A chamber in the base of the apparatus entraps projectiles, permitting collection and removal without damage for reuse.

13 Claims, 16 Drawing Figures

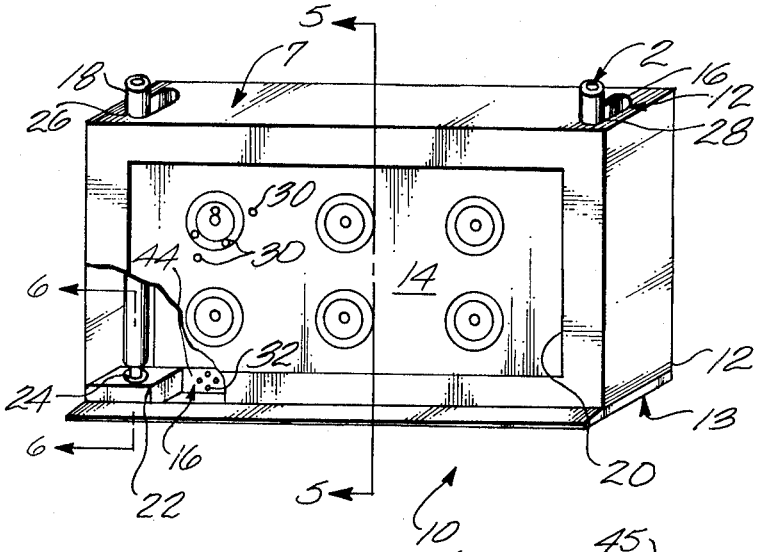
Fig. 1
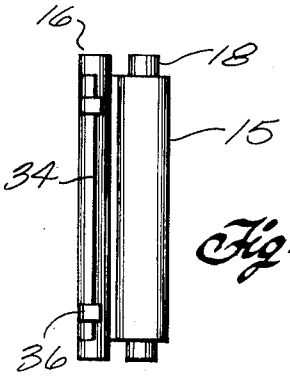
Fig. 2
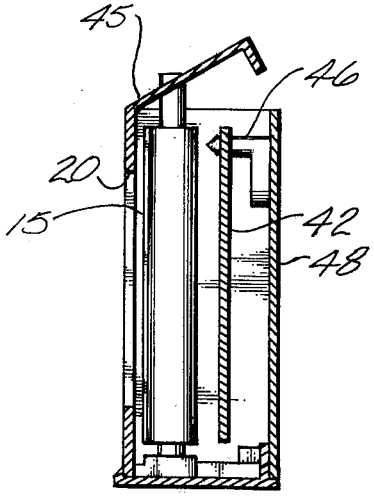
Fig. 5
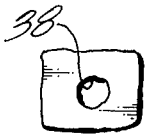
Fig. 3
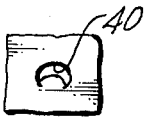
Fig. 4A
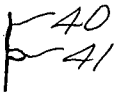
Fig. 4B
Fig. 6
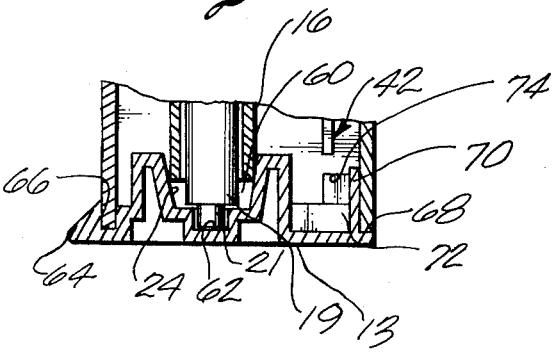
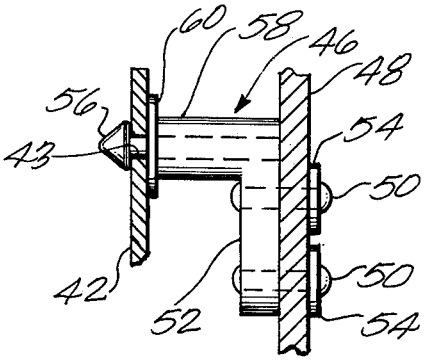
Fig. 7

INDICATING TARGET

REFERENCE TO RELATED APPLICATIONS

This application is a continuation in part application of Ser. No. 854,021, filed Nov. 23, 1977, now abandoned.

BACKGROUND OF THE INVENTION

The present invention relates to target systems and in particular to a self-contained, portable target system providing a highly visible hit indication without ricochet or loss of projectiles.

In the past, target apparatus for use with airguns and conventional firearms have typically utilized paper targets. Targets fabricated of paper have been found to be less than satisfactory in providing a clearly visible marking of the spot of projectile impact which is easily discerned from a distance. In addition, paper targets, while printable, are usually of a stock and texture that prevents good quality, attractive printing of target indicia. Paper targets also wear rapidly and require replacements after relatively few hits.

The use of targets with airguns and $CO_2$ operated guns and the like make it desirable to provide a target system which is highly portable and at the same time is safe and able to sustain a high level of use before target replacement is required, entraps projectiles for reuse and with which minimum time is lost in changing individual targets.

The prior art with respect to such target systems is extensive. In some instances, such targets are backlighted to enhance the visibility of projectile holes. Illustrative of such prior art are U.S. Pat. Nos. 1,027,371; 1,223,519; and 3,334,902. In many instances, such systems are movable and utilize rolls or reels upon which target material is wound. Typical of such prior art are U.S. Pat. Nos. 840,610; 1,482,725; 1,981,293; 2,034,839; 2,048,155; 398,186; and 3,519,272.

Such prior art systems are generally characterized by a number of difficulties. An important problem is the lack of safety, but, in addition, they are generally expensive to manufacture and operate. Target replacement is a problem due to elaborate winding mechanisms. The movement of individual targets into and out of the shooting window or aperture is also cumbersome and slow.

SUMMARY OF THE PRESENT INVENTION

The present invention provides a target apparatus comprising a housing having a target opening. The apparatus includes a length of perforatable material having target indicia thereon and tubular roller means having the target material coaxially wound thereon. Means for supporting the roller means are mounted in the housing, the supporting means being located to position a portion of the length of target material at the opening. A backstop is mounted within the housing at a predetermined distance interiorly from the target opening, the backstop being fabricated of a flexible material and of a size commensurate with the target opening. Finally, restraining means associated with the roller supporting means for engaging and releasably locking the roller means with targets supported thereon for accurately and tautly positioning a specific target in registration in the target opening is also provided.

In the preferred embodiment, the length of targets is made of a synthetic material such as polyethylene. Polyethylene is desirable because of the characteristic hole which a projectile passing through such material makes. The projectile impact on the target cuts or tears a hole in the target material that is essentially identical in size and cross-section to the projectile itself. The target material is either torn away completely or is torn around a major portion of the circumference, leaving a hole of a size which is highly visible when viewed against a contrasting backstop. The provision of a backstop located intermediate the front and back wall of the housing prevents ricochets and in addition allows the use of the target system as a self-contained housing for the collection of spent projectiles after impinging upon the backstop. The backstop and the polyethylene target material cooperate to contain the spent projectiles within the housing. The use of roller means and supports for the roller means provides a quick and inexpensive mounting for tubes or cylinders upon which the target material is reeled. The provision of cooperating receptables at the base of the support means enables the tubes or cylinders to be wedged into position, causing the target to be displayed tightly in the target opening. In its preferred embodiment, the housing is constructed of injection-molded plastic, corrugated board or the like. Because of the more sharply outlined projectile holes, reduced weight and high degree of colorability, the polyethylene targets of the present invention are a tremendous improvement over traditional paper targets while being competitive with paper targets in terms of cost. Polyethylene targets are significantly more durable in the number of discernable hits sustainable without tearing in comparison to paper. Polyethylene likewise has greater tear resistance than paper, making for increased usage as well as longer lasting serviceability in cooperation with the backstop in confining spent projectiles within the housing.

DESCRIPTION OF THE DRAWINGS

These and other details of the invention will be better understood by reference to the figures of the drawing, in which:

FIG. 1 is a perspective view, partially fragmented, of the target system according to the present invention;

FIG. 2 is a rear elevational view of the target roll assembly for use with the system of FIG. 1;

FIG. 3 is an enlarged elevational view of a projectile hole produced in the target of the present invention;

FIGS. 4A and 4B are enlarged elevation and side elevation views respectively of a partial projectile hole;

FIG. 5 is a cross-sectional view taken along lines 5—5 of FIG. 1 with the hinged top partially open;

FIG. 6 is an enlarged partial section taken along lines 6—6 of FIG. 1;

FIG. 7 is an enlarged fragmented side elevational view of the backstop mounting bracket;

DESCRIPTION OF A SPECIFIC EMBODIMENT

Figure 8:
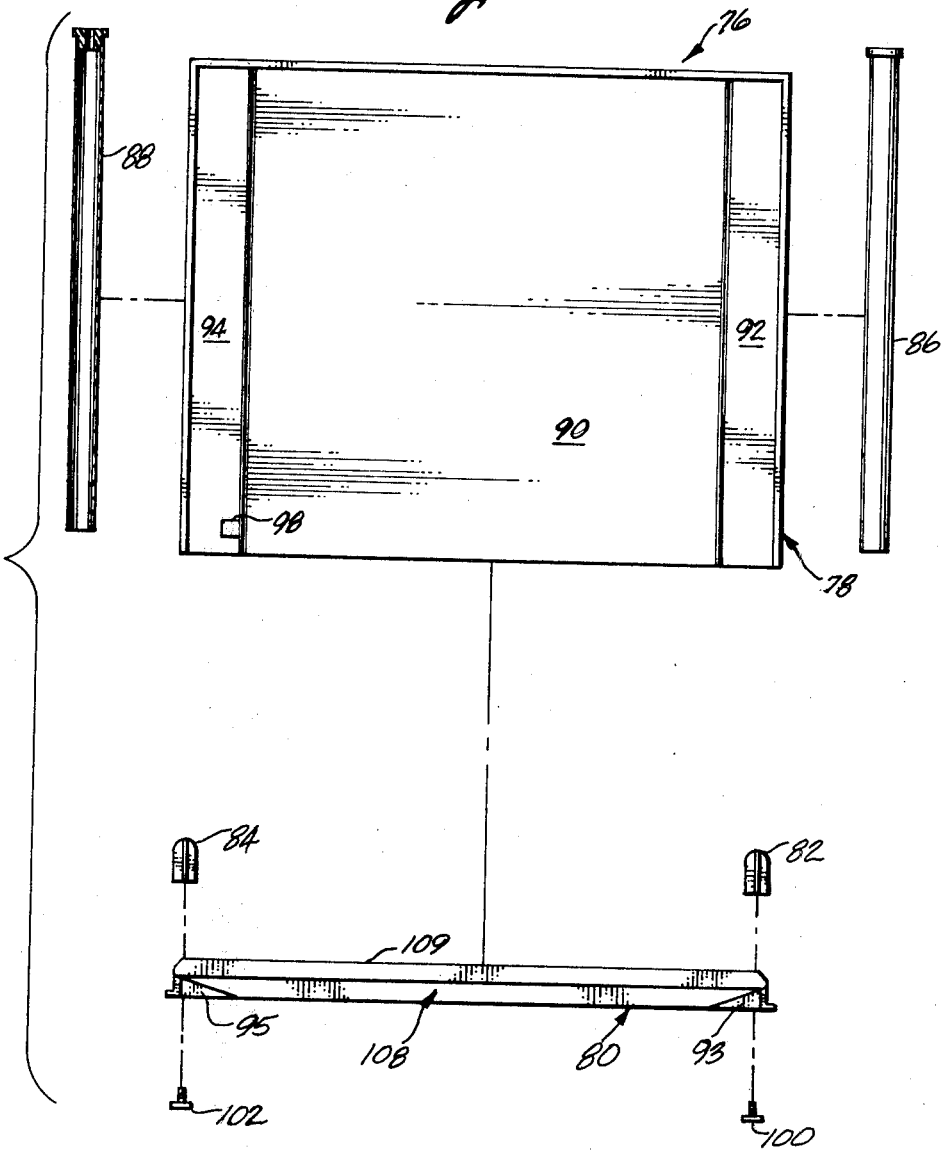
FIG. 8 is an exploded front elevational view of an alternate embodiment of a target housing and tubular target supports according to the present invention.

A target apparatus 10 according to the present invention is shown in FIG. 1. Apparatus 10 comprises a housing 12 enclosing a roll of targets 14 on a pair of spaced-apart elongated rollers or reels 16, 18. Rollers 16, 18 are a pair of elongated tubes which are mounted on locator rods 19 and seated in receptacles 24 at opposite sides of the housing. The targets 14 are printed on a plastic sheet 15, such as polyethylene, which is wound on one of said rollers to be unreeled and rewound on the opposite roller after use with specific targets on the sheet being brought into registration in an opening 20 at the front of the housing.

As shown in FIG. 1, housing 12 is an upright, narrow elongated box-like structure which is closed at the rear side and defines opening 20 at the front. Housing 12 includes a one-piece molded base 13 in which is formed support 22 defining a receptable 24 for receiving the foot or base of roller 18. An elongated aperture 26 is provided at the top of housing 12 which registers with and passes the upper end of roller 18 therethrough. A similar aperture 28 is located at the opposite side of the upper portion of housing 12 to register with and allow the upper portion of roller 16 to pass therethrough.

In use, a target is unreeled and brought into registration with the window 20. A marksman using an air rifle or the like directs BB shot or pellets 32 at the target producing shot holes 30. The projectiles 32 pass through the polyethylene target and strike a backstop 42 located interiorly of the housing where a portion of their energy is absorbed. The projectiles 32 rebound from backstop 42, strike the rear of the polyethylene target, fall and are collected in the bottom of the housing enabling their subsequent reuse.

In one embodiment of the invention, twenty individual targets are printed on the length or sheet of polyethylene. The individual printed targets, as presently contemplated, comprise various subject matter, for example, bull's eye targets, silhouettes and the like. If desired, individual targets are bordered to facilitate the indexing or registration of the target with opening 20 in the target housing 12.

An elevation view of the roll of targets before assembly into the target apparatus is shown in FIG. 2. As shown therein, the polyethylene roll 15 is wound up on roller 18. The leading edge 34 of the roll of material having the plurality of targets printed thereon is secured to roller 16 by means of pressure sensitive tape 36. Alternatively, adhesives, clips and the like can be used. As will be discussed in more detail in conjunction with FIG. 5, the sheet of targets is unrolled in a manner similar to rolling and unrolling scrolls. When in place in the housing, the base ends of the rollers 16, 18 are frictionally secured in receptacles 24 molded into base 13 which are located in the interior of the housing 12. When placed in the housing at the start of the use of a new set of targets, the top of the housing is opened, roller 18 is unreeled until a length of target material of the housing 12 and roller 16 is located at the opposite side of the housing. The rollers are then placed over locator rods 19 and slid downwardly to be seated in their receptacles. A specific target is then indexed into position with opening 20 and rollers 16, 18 are turned in opposite directions, pulling the target material taut. The target apparatus is then ready for use. When a sufficient number of holes have been created by target practice with a given target, such that that particular target is no longer useful, roller 16 is advanced or wound by hand to reel up the used target thereon and cause a new, fresh target to be unreeled from roller 18 and displayed in window 20.

A projectile piercing the target creates a hole 38 (FIG. 3) or a partial hole 40 (FIGS. 4A and 4B). The projectile passing through the target either completely tears away the target material or tears away material around more than half of the circumference, creating a tab 41 and thereby bending the tab of torn material, making the hole highly visible, particularly when the backstop behind the target is colored so as to contrast with the color of the target, allowing the marksman and spectators to readily see where the projectile has penetrated the target.

Referring now to FIG. 5, a side elevational view in section taken along lines 5—5 of FIG. 1, it can be seen that projectiles piercing target 14 impact against a backstop 42 which stops the projectiles without ricochet. The projectiles rebound striking the rear of the target material. The energy of the projectiles is sufficiently spent such that they do not repierce the target due to energy absorption by the backstop and its spacing from the front of the housing. Several preferred materials can be utilized as the backstop, including a pad of a rubber material or of a woven material having a size slightly greater than the opening 20 to provide a barrier for projectiles regardless of the angle of entry. When projectiles 32 have penetrated the target, most of their remaining energy is absorbed by the backstop with a minimum of rebound so that none of the projectiles have enough energy to repenetrate the target. The use of a plastic material such as polyethylene having a superior strength also deters projectiles from repenetration. The projectiles thus drop into collection area 44 at the bottom of the housing.

The installation and removal of target rolls will be described in conjunction with FIGS. 5 and 6. The top of housing 12 is hinged to provide a flap 45 which is lifted up and away from the top of the housing as slots 26 and 28 clear the top or roller 16 and 18 respectively. The rollers containing the spent targets are then removed by hand from the locator rods 19 and a new target roll is set in place. The first target is stretched across the opening by rotating the roller with the target material wound thereon and then pushing and wedging the rollers 16, 18 with target material rolled thereon into the roller receptacles 24. Once in place, flap 45 is closed and latched to the top of the housing.

When it is desired to register or index the next target in opening 20, it is necessary to lift or pull up on target rollers 16 and 18 without opening flap 45 to free the bases thereof from the roller-locking receptacles or pockets 24. The rollers are rotated until the next target is brought into position in window 20. The target material is then pulled tight and taut between the rollers and the base of the target rollers is again pushed into the roller-locking pockets.

Backstop 42 is supported adjacent its top edge by means of brackets 46 fixed to the rear wall 48 of housing 12. The backstop 42 is hung from the brackets 46 and extends downwardly past the bottom of opening 20. As seen from FIG. 7, bracket 46 is secured to rear wall 48 by means of fasteners 50 passing through the rear wall and through the downward extending portion 52 of bracket 46. Washers 54 are provided for supporting the bracket on the fasteners and are particularly useful where the material from which the housing is fabricated is corrogated paper or the like. A retainer 56 extends outwardly from upper portion 58 of bracket 46 and passes through an aperture 43 in backstop 42. A retaining washer 60 completes the assembly whereby the backstop is supported by the bracket.

In one embodiment, the backstop has pre-cut or molded holes formed therein in registration with the location of the retainers 56 and the backstop is assembled or mounted on the brackets by stretching the pre-cut or molded holes over the retainers 56. Once in position, the backstop 42 is then allowed to drape freely from the retainers.

The base 13 of housing 12 is shown in enlarged sectional detail view in FIG. 6. It is preferably fabricated of injection molded plastic to provide a cup-shaped or conical area 60 located approximately midway between the front and back edges of the base member. This cup-shaped member has a well or counter-sunk portion 62 for receiving the target roller locator rods 19. The base 21 of rod 19 is cemented or otherwise secured in well 62 to hold the locator rod in position. The hollow rollers 16 and 18 are of a cylindrical configuration and a diameter such that they slip over and are slidingly fitted on rods 19. The upper portion of cup-shaped area 60 has slanted sides to provide the receptacles 24 whereby the target rollers are wedged or secured in position to hold the target taut. When a target has been brought into position between the rollers, rollers 16, 18 are pushed down into cup-portions 60, the wedging action produces a friction-fit and holds the target taut while in use. To bring a new target into position, rollers 16 and 18 are raised out of frictional engagement with cup-shaped portions 60 to permit the turning of the rollers and the reeling of a new target into position.

The front portion of base 13 has a sloping or slanted surface 64. A slot 66 is located immediately interiorly of surface 64. Surface 64 provides a deflecting surface for projectiles which have been poorly aimed. Slot 66 provides the means for receiving and supporting the front portion of housing 12 in position on the base. Likewise, the rear wall 48 of housing 12 is slid into position on shelf 68 of the base. Rear wall 48 is then secured to base 13 by riveting, glueing or adhesively securing the base portion of rear wall 48 to a vertical member 70 molded into base 13. Interiorly of vertical member 70, the interior surface 72 of housing 13 is sloped or slanted away from a projectile-discharging aperture 74 to prevent the collected projectiles from prematurely existing. The sloping surface 72 inclines away from aperture 74 preventing the projectiles 32 falling into the bottom of the housing from rolling toward the aperture, under the influence of gravity, until the housing is tipped or tilted to the desired angle to overcome the slope and cause the projectiles to pass from within the interior of the housing through aperture 74 for collection and reuse by the target user.

An alternate and presently preferred target apparatus according to the present invention is shown in FIGS. 8 to 14. As shown in FIG. 8, the apparatus includes a target housing 76 which includes an upright, narrow, elongated, box-like housing shell 78, a base 80 and supports 82, 84 secured to base 80 for mounting tubular target material supporting rollers 86, 88. As better seen when viewed in conjuction with FIGS. 9 and 10, shell 78 has a back portion 90 with which two side panel portions 92, 94 are integrally formed and extend forward at an angle to back portion 90 to the front side 96 of the housing. The front side or target side 96 of the housing is totally open. Target material extends from one roller along the side of the housing, across the open front 96, back along the opposite side of the housing to the opposite roller. The tubular rollers 86, 88 and the roller support means 82, 84 are located immediately behind side panels 92, 94 on base 80. To assist in the removal of a spent projectiles entrapped within the housing after being shot at the target, a BB or pellet removal aperture 98 is provided in side panel 94.

In assembly, base portion 80 is slidably fitted into the bottom of shell 78 with the base of side panels 92, 94 abutting triangular-shaped panels 93, 95 respectively on base 80. Fasteners such as screws 100, 102 secure supports 82 and 84 and base 80 to shell 78. Alternatively, supports 82, 84 are cemented into receptacles integrally formed in base 80 and base 80 is similarly secured to shell 78 by cementing or other bonding process such as ultrasonic welding.

Figure 9:
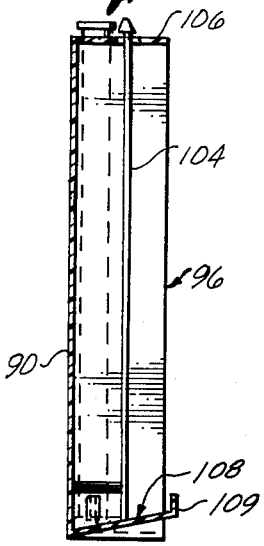
FIG. 9 is a sectional side elevation view of the target assembly of FIG. 8.
Figure 10:
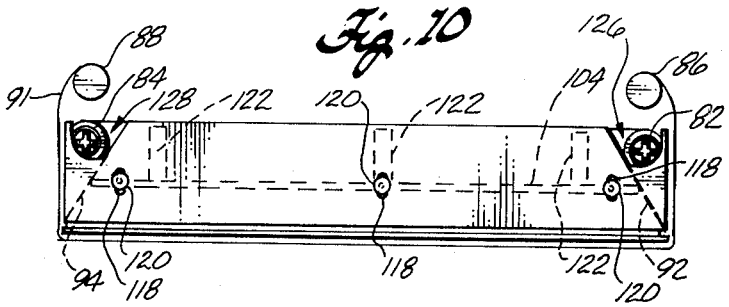
FIG. 10 is a top plan view of the target assembly with tubular target rollers housing target material wound thereon positioned adjacent the roller mounting means on the housing.

As seen in FIGS. 9 and 10, a backstop 104 is supported from the top 106 of the target housing 76 and is located interiorly of the target housing at a point which is approximately midway between front edge 96 and back panel 90. Base 80 includes rearwardly inclined shelf 108 integrally molded into base 80. Shelf 108 extends upwardly from back panel 90 to a position slightly beyond the front edge 96 of the housing and terminates in a vertical lip 109.

The tubular rollers are adopted to be mounted on supports 82, 84 that are short pegs which are cross-shaped in cross section. Supports 82, 84 have an effective outer diameter slightly smaller than the inner diameter of tubular rollers 86, 88. When mounted, tubular rollers 86, 88 are placed on pegs 82, 84 and slid axially down thereon to provide the means whereby the rollers are maintained in position relative to the housing. As will be described in more detail in conjuction with FIGS. 12A and 12B, the roller support pegs 82, 84 are associated with circumscribing restraining means for releasably locking the tubular rollers in position with respect to the housing.

Figure 11:
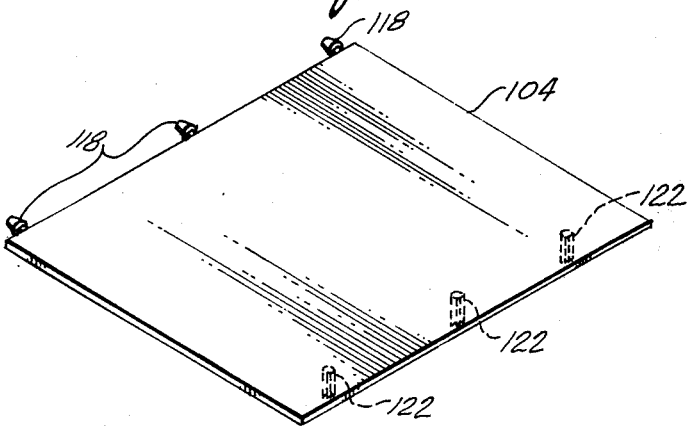
FIG. 11 is a prospective view of the backstop used with the target embodiment of FIGS. 8, 9, and 10.

As seen in FIGS. 10 and 11, backstop 104 is provided with conically-shaped extensions 118 which are integrally formed into the backstop and extend upwardly therefrom. Extensions 118 are adapted to be force fitted through apertures 120 located at the top of shell 78 to position the backstop at the predetermined position within the housing 76. Spacers 122 extend from the back side of backstop 104 and provide the means whereby the backstop is prevented from contacting the back panel 90 of the shell when impacted by a projectile. Backstop 104 thus provides a pliable barrier for stopping the projectile wherein spacers 122 act to prevent backstop 104 from being forced backwardly under the force of the projectile to a point where it would bear directly against back panel 90, thus resulting in too strong a rebound of the projectile from the back panel of the housing. The backstop is positioned and selected of a material such that sufficient energy is absorbed and removed from the projectile to result in a rebound of the projectile from the backstop with an energy insufficient to repenetrate the target material located at the front of the housing.

Further details of the structure of the target apparatus and the steps involved in the installation and removal of target rolls will be described in conjunction with FIGS. 10, 12A, and 12B. The sequential placement of individual targets on a target roll in registration with the front or open side of the target apparatus will also be described.

Rollers upon which target material 91 is wound are first held and one roller is unreeled relative to the other. Rollers 86, 88 are thus separated relative to each other to expose a length of target material sufficient to cover the sides and front of housing 78. The target material is positioned across the front side 96 with the bottom edge just above shelf 108 and the rollers 86, 88 are positioned adjacent peg supports 82, 84.

Figure 12A:
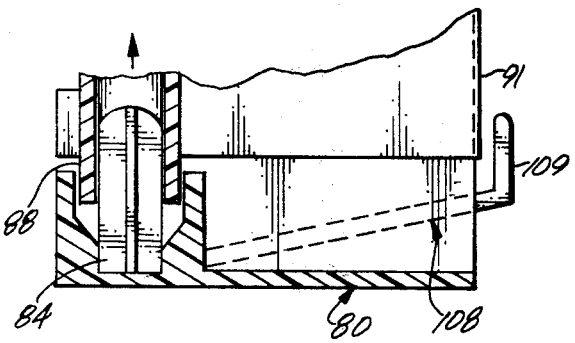
FIG. 12A is an enlarged detailed view of a target roller in the released position.
Figure 12B:
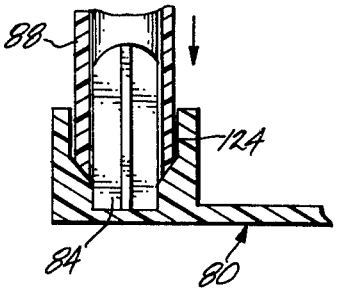
FIG. 12B is an enlarged detail view of a target roller in the locked position.

As seen in FIG. 12A, the bottom open end of roller 88 is then placed over peg support 84 and axially slid down onto the peg to an intermediate position. Roller 86 is similarly mounted. Rollers 86, 88 are then manipulated to take up any slack target material and to accurately register a specific target in the target opening at the front of the housing. When the target material is taut, roller 88, as shown in FIG. 12B, is slid further down peg 84 into circumscribing receptacle 124 which is conically shaped at its bottom. The converging sides of the conically shaped bottom of receptacle 124 locks tube 88 in position.

In cooperation with a similar receptacle for roller 86, the two receptacles lock tubes 86, 88, thus maintaining the target material taut across the target opening.

Pushing down on the rollers wedges and locks the rollers and target material in position. Raising them unlocks the bases of the rollers permitting a new target on the roll to be reeled into position or the removal of a spent set or roll of targets. When a new target is positioned, the rollers are once again pushed down on peg supports 82, 84 into locking receptacles 124.

Figure 13:
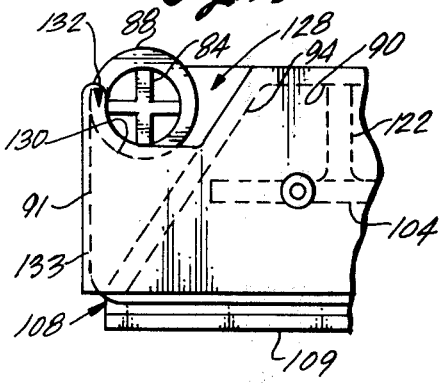
FIG. 13 is an enlarged detail of the target housing and top roller support.

The support for the top end of roller 88 is shown in FIGS. 10 and 13. An elongated, vertical compartment 126, 128 is located at each rear corner of housing 78. Compartment 128 is defined by side 94 of housing 78, base 80 and a curved support 130 formed into the housing at the top 106 between the rear of each portion 94 and the outer side edge of the housing. The top of the compartment is formed with a lip 132 which overlaps the top end of roller 88 to retain that end of roller in the compartment. The cooperative action of the taut target material 91, peg support 84 at the bottom and curved support 130 at the top holds and retains the roller against the housing to provide a secure mounting. A mirror image of the foregoing structure arrangement is provided for roller 86 at the opposite side of the housing.

Figure 14:
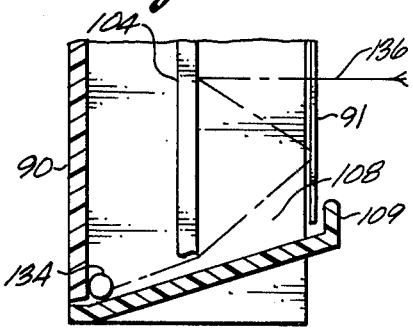
FIG. 14 is an enlarged detail view of the bottom of the housing.

As seen in FIGS. 13 and 14, target material 91 extends along the side of the housing 76 under an outwardly extending lip 133, across the front of the housing with the bottom edge of the target material just above shelf 108 such that lip 109 overlaps the bottom of the target material. The overlap of the lip 109 and target material 91 is important in retaining projectiles 134 such as BB's or pellets within the housing when they rebound from backstop 104.

The path 136 of a typical projectile 134 is shown in FIG. 14. The projectile typically pierces the target 91 and impacts on backstop 104 where a substantial portion of its energy is absorbed. Sufficient energy is left, however, to cause the projectile to rebound from backstop 104 and impact against the backside of the target material. The energy of the projectile has been reduced to the extent that it has insufficient energy to repierce the target material. Instead it rebounds once more from the target material and falls to the bottom of the housing onto shelf 108. The projectile then follows the incline of shelf 108 to rest against the back wall 90. Tilting of the housing to one side causes the accumulated projectiles to be rolled to removal aperture 98, thereby saving the projectiles without damage to them, thus permitting their repeated reuse.

What has been provided is a target and target housing which is safe, inexpensive to manufacture and attractive to use. The target of the present invention is constructed so as to essentially eliminate any possibility of ricochet of projectiles directed at it. By providing target material of a plastic material such as polyethylene rather than paper or other conventional materials, improve visual performance by the target is obtained, making the location of hits easier to see and the marking of hits and scoring facilitated. The housing also provides the means whereby the projectiles can be collected without damage and reused rather than lost. The interior of the housing is constructed with a sloped interior base portion in such a way that spent projectiles are easily and quickly collected and removed. The ability to retain spent projectiles without any significant damage is an important attribute of the present invention. Projectiles such as BB's or pellets can now be reused a number of times without causing the rifle or gun to jam.

The safety of the target apparatus of the present invention also proceeds from the use of plastic or heavy paper material as the preferred material for target housing construction and the configuration and location of the various elements of the target apparatus. Errant projectiles which miss the target aperture but pass through the paper housing lose a significant portion of their energy in penetrating the paper reducing the possibility of rebounding back through the front of the housing. In the preferred alternate embodiment, the entire front side of the housing is open and thus has essentially no structure at the front of the apparatus that would tend to cause the projectiles to deflect or ricochet back toward the shooter or observers. Location of backstop in the middle of the housing interior and the target rollers directly behind structural portions of the housing prevents misaimed projectiles from striking the rollers and ricocheting back to the shooter.

The target apparatus of the present invention likewise provides a means whereby insertion, removal and replacement of target rolls is quick and easy. An extremely simple yet secure and quick-locking means for securing the targets in position is provided. The provision of clearance slots in the embodiment of FIGS. 1–7 at the top of the housing means that the top of the housing can be opened and closed without interfering with the target assembly. In the preferred embodiment, access to the roller mountings is open and unimpeded eliminating even the clearance slots. The use of polyethylene likewise means that the targets can be printed with a choice of colors and designs. In the embodiment wherein the housing 12 is manufactured of corrugated paper, a permanent location is provided for reproducing operational instructions. In an alternate embodiment, the rear of the housing can be apertured or slotted to provide the means whereby the target can be hung on a wall.

What is claimed is:

1. A target apparatus comprising:

a housing having a target opening;

a length of perforatable material having target indicia thereon;

tubular roller means having the target material coaxially wound thereon;

means for supporting the roller means mounted in the housing, the supporting means being located to position a portion of the length of target material at the target opening;

a backstop hung interiorly of the housing at a point spaced between the front and back walls of the housing, the backstop being fabricated of a flexible material and of a size commensurate with the target opening; and conically shaped receptacles located at opposite sides of the housing for engaging and releasably locking the roller means with targets supported thereon for accurately and tautly positioning a specific target in registration in the target opening.

2. A target apparatus according to claim 1 wherein the supporting means for the tubular roller means are peg-like extensions secured at one end thereof in the base of the receptacles.

3. A target apparatus according to claim 2 wherein the tubular roller means are a pair of elongated cylinders located at opposite ends of the length of targets, the cylinders being adapted to be axially slid into registration over the peg-like extensions.

4. A target apparatus according to claim 3 wherein the tubes have a predetermined diameter such that when fitted into the conically-shaped receptacles, the tubes with the targets wound thereon are frictionally held in position within the receptacles.

5. A target apparatus according to claim 4 wherein the top of the housing is hinged to permit the insertion and removal of the assembly of the tubes and length of targets wound thereon.

6. A target apparatus according to claim 5 wherein the top of the housing is provided with a pair of elongated apertures to receive and pass the free ends of the tubes supporting the length of targets.

7. A target apparatus according to claim 6, including an aperture located in a side wall of the housing for removal of projectiles fired at the target.

8. A target apparatus according to claim 7 wherein the interior of the housing is sloped in a direction descending away from the aperture.

9. A target apparatus according to claim 4 wherein roller receiving compartments are provided to permit the insertion and removal of the assembly of the cylinders and length of targets wound thereon.

10. A target apparatus according to claim 5 wherein the front of the housing is provided with a vertical lip overlapping the bottom edge of the target material extending across the aperture in the housing.

11. A target apparatus according to claim 1 wherein the length of targets is fabricated of a thin plastic material.

12. A target apparatus according to claim 11 wherein the plastic material is polyethylene.

13. In a target system comprising a housing, an aperture for displaying individual targets, and means for fixedly mounting a target roll in the housing with an individual target displayed in the aperture including peg-like supports mounted within the housing, the improvement comprising:

a pair of hollow, elongated, cylindrical tubes, the tubes having an interior diameter such that the supports are slidably receivable therein;

conically-shaped receptacles circumscribing the supports;

a length of polyethylene target material having a plurality of individual targets printed thereon wound upon and extending between the tubes; and means for securing the opposite ends of the length of target material edgewise to the tubes, the tubes having a diameter such that the tubes are frictionally engaged by the sides of said receptacles to fixedly secure the target material in the housing and tautly display an individual target across the aperture.

* * * * *